US007926592B2

(12) United States Patent
Smith et al.

(10) Patent No.: US 7,926,592 B2
(45) Date of Patent: Apr. 19, 2011

(54) STEERABLE DRILLING SYSTEM

(75) Inventors: David L Smith, Sugar Land, TX (US); Christian Menger, Clifton Bristol (GB); Edward Richards, Witney Oxon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/370,667

(22) Filed: Mar. 8, 2006

(65) Prior Publication Data

US 2006/0207798 A1 Sep. 21, 2006

(30) Foreign Application Priority Data

Mar. 18, 2005 (GB) ..... 0505557.9

(51) Int. Cl.
*E21B 7/04* (2006.01)

(52) U.S. Cl. ..... 175/81; 175/61; 175/308

(58) Field of Classification Search ..... 175/61, 175/73, 81, 308, 312; 166/105.1
See application file for complete search history.

(56) References Cited

U.S. PATENT DOCUMENTS

| | | | | |
|---|---|---|---|---|
| 4,488,607 | A * | 12/1984 | Hayatdavoudi et al. | 175/65 |
| 4,688,650 | A * | 8/1987 | Hayatdavoudi et al. | 175/324 |
| 4,711,720 | A * | 12/1987 | Young | 210/512.2 |
| 6,116,355 | A | 9/2000 | Thorp | |
| 6,189,613 | B1 * | 2/2001 | Chachula et al. | 166/265 |
| 6,394,183 | B1 | 5/2002 | Schrenkel | |
| 6,715,570 | B1 * | 4/2004 | Downton et al. | 175/314 |
| 2004/0104051 | A1 | 6/2004 | Moriarty | |
| 2005/0236324 | A1 * | 10/2005 | Mildren et al. | 210/512.1 |

FOREIGN PATENT DOCUMENTS

EP 0033654 8/1981

* cited by examiner

*Primary Examiner* — David J Bagnell
*Assistant Examiner* — Robert E Fuller
(74) *Attorney, Agent, or Firm* — Vincent Loccisano; Jeremy Welch; Charlotte Rutherford

(57) ABSTRACT

A steerable drilling system including a bias unit and a separator. The separator is arranged to remove particulate matter from the supply of pressurized drilling mud to the actuator of the bias unit. The separator includes a hydrocyclone located upstream of the actuators. The hydrocyclone includes a housing defining a substantially conical recess having a large diameter end and a small diameter end. An inlet is in fluid communication with the large diameter end for providing the drilling mud thereto. A first outlet is in fluid communication with the small diameter end for outlet of relatively dirty mud. A second outlet is in fluid communication with the large diameter end for outlet of a supply of relatively clean mud for the plurality of actuators.

13 Claims, 2 Drawing Sheets

STEERABLE DRILLING SYSTEM

BACKGROUND

This invention relates to a steerable drilling system for use in the formation of subterranean boreholes, for example for subsequent use in the extraction of oil or natural gas.

One form of steerable drilling system includes a bias unit having a plurality of bias pads. Each bias pad is moveable from a retracted position to an extended position by an associated piston operable by pressurised drilling fluid or mud, a suitable valve arrangement being provided to control the supply of drilling fluid or mud to each piston and thereby control the positions occupied by the bias pads at any given time.

The drilling fluid or mud sometimes carries with it particles or debris from further up the borehole being formed. The presence of such particles or debris can cause wear or malfunction of the valve arrangement and/or the pistons. Clearly this is undesirable. In order to reduce wear and the risk of malfunction it is known to provide a junk basket or filter to collect particles carried by the flow of drilling fluid or mud before the fluid or mud reaches the valve arrangement and pistons. Such devices are intended to remove fairly large particles which, potentially, could cause malfunction or blockage. They are not intended for, or suitable for, removal of small, dense particles which cause erosion.

It is an object of the invention to provide a steerable drilling system of reduced susceptibility to erosion.

According to the present invention there is provided a steerable drilling system comprising a bias unit, the bias unit having at least one actuator operable by pressurised drilling fluid or mud, in use, and a separator arranged to remove particulate matter from the supply of pressurised drilling fluid or mud to the or each actuator, the separator comprising a hydrocyclone.

The use of a hydrocyclone as the separator is advantageous in that it can be used to separate relatively dense particles from the supply of drilling fluid or mud, even when the dense particles are of fairly small dimensions and so may be capable of passing through a junk basket or filter. As it is the relatively small, dense particles that tend to cause erosion, the use of a hydrocyclone allows a reduction in erosion damage to be achieved.

The separator may be integrally formed with the bias unit. Alternatively, the separator and bias unit may be separate components, the separator being located upstream of, preferably immediately upstream of, the bias unit so that the drilling fluid or mud from which matter has been separated by the separator can be supplied directly to the bias unit.

The invention also relates to a hydrocyclone adapted for use in such a steerable drilling system.

BRIEF DESCRIPTION OF THE DRAWINGS

The invention will further be described, by way of example, with reference to the accompanying drawing, in which.

DETAILED DESCRIPTION

Figure 1:
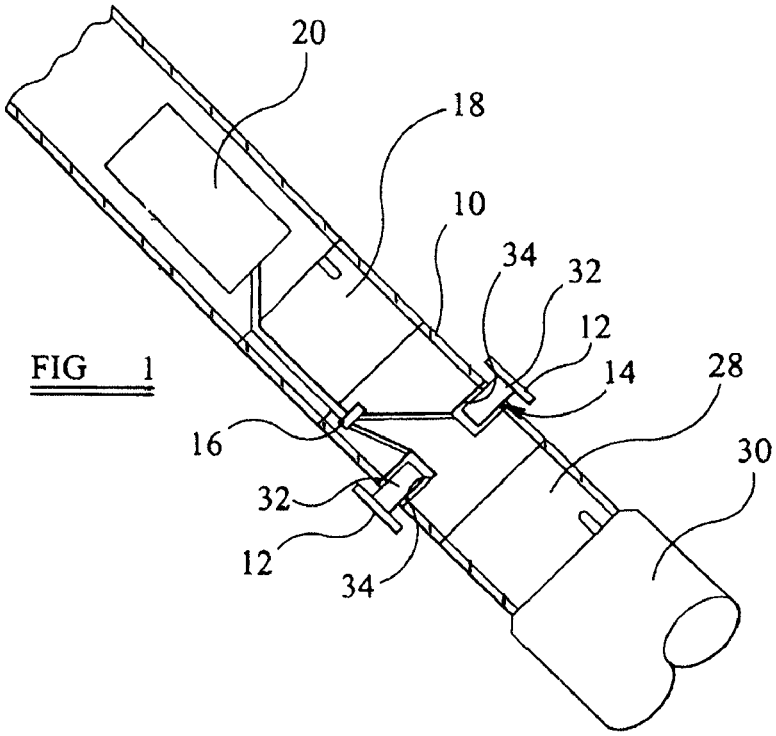
FIG. 1 is a diagrammatic illustration of part of a steerable drilling system in accordance with an embodiment of the invention.
Figure 2:
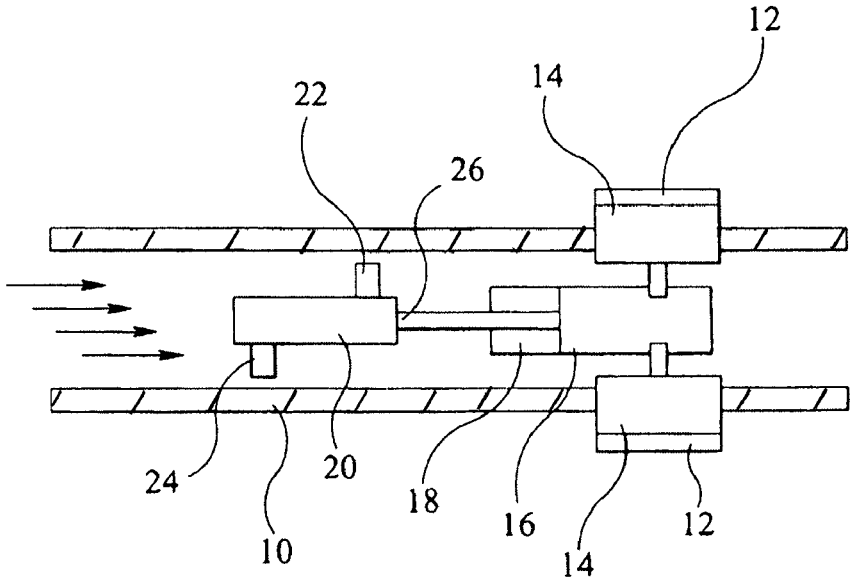
FIG. 2 is a schematic representation of part of a steerable drilling system wherein the separator is integrally formed with the bias unit.

FIGS. 1 and 2 illustrate, diagrammatically, configurations of a steerable drilling system for use in the formation of a borehole, for example for subsequent use in the extraction of hydrocarbons. FIG. 2 illustrates a variation of a steerable drilling system where like reference numerals are used to refer to similar components as FIG. 1 and the separator is integrally formed with the bias unit. The part of the drilling system illustrated in FIG. 1 comprises a housing or drill collar 10 into which drilling fluid, referred to hereinafter as mud, is pumped. The drill collar 10 has mounted thereon a plurality of bias pads 12, each bias pad being moveable between a radially inner position and an extended position in which it engages the wall of the formation being drilled to allow the application of a sideways acting load to the drill collar 10 which is used in steering of the drilling system. In one fairly simple form of drilling system, the drill collar 10 carries a motor 28 and a drill bit 30, and it will be appreciated that the application of a sideways acting load to the drill collar 10 results in the application of a sideways acting load on the drill bit 30 which, in turn, urges the drill bit 30 away from the centreline of the adjacent part of the borehole, thereby promoting the formation of a curve. A steerable drilling system of this type is sometimes referred to as a push the bit drilling system. It will be appreciated, however, that a number of other forms of steerable drilling system are known, and the invention is equally applicable to such drilling systems.

Each bias pad 12 is moveable between its radially inward and extended positions by means of an associated actuator 14. The actuator takes the form of a piston 32 slidable within a cylinder 34, mud under pressure from the interior of the drill collar 10 being supplied to one end of the piston 32 to cause movement of the piston 32 and hence movement of the associated bias pad 12 from its retracted, radially inner position to its extended position. The supply of mud under pressure to the actuators 14 is controlled by a suitable valve arrangement 16 operable under the control of a suitable control arrangement 18. A range of suitable valve arrangements 16 and control arrangements 18 are known, and so these components will not be described in further detail.

Figure 3:
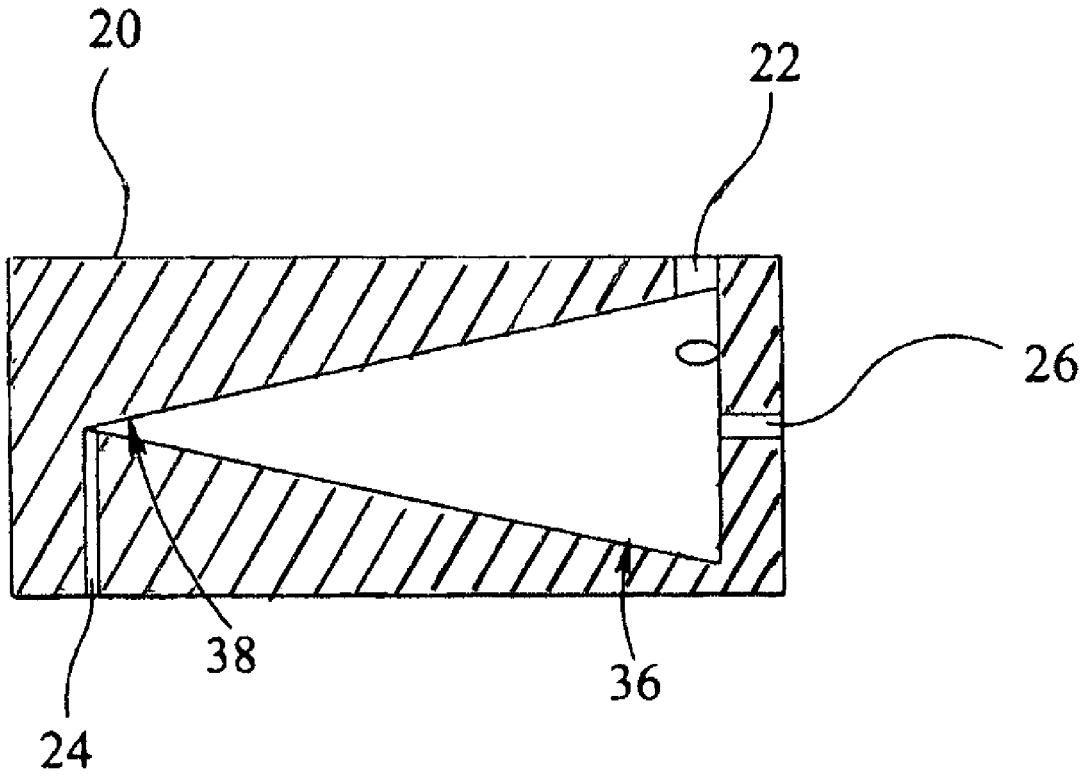
FIG. 3 is a diagrammatic view illustrating the separator of the system of FIG. 1.

In accordance with the invention, a separator in the form of a hydrocyclone 20 is provided within the drill collar 10 to allow the separation of relatively dense particles from the mud supply to the actuators 14. The hydrocyclone 20 includes an inlet 22 through which mud under pressure from the interior of the drill collar 10 enters the hydrocyclone 20. In the interior of the hydrocyclone 20 is a substantially conical recess (see FIG. 3), the mud being supplied through the inlet 22 generally tangentially into the large diameter part 36 of the conical recess. The centrifugal acceleration imparted into the mud forces the relatively dense particles carried by the mud towards the wall of the conical recess, the particles working their way towards the small diameter end 38 and apex of the conical recess from where they can exit the hydrocyclone 20 through a dirty mud outlet 24, the mud exiting the hydrocyclone 20 through the dirty mud outlet 24 rejoining the flow of mud within the drill collar 10 towards the drill bit 30. Mud from which the relatively dense particles have been separated by the hydrocyclone 20 exits the hydrocyclone 20 through a cleaned mud outlet 26 at the large diameter part 36 of the conical recess from where the cleaned mud is supplied to the valve arrangement 16 and actuators 14.

As hydrocyclones work by separating relatively dense matter from relatively low density matter, rather than by separating relatively large particles from the flow of mud, it will be appreciated that the use of the hydrocyclone 20 in accordance with the invention removes particles which would otherwise be likely to cause erosion within the valve arrangement 16 and actuators 14.

Although not illustrated, a conventional junk basket or filter may also be incorporated into the steerable drilling system in order to remove relatively large dimension particles from the supply of mud to the valve arrangement 16 and actuators 14.

It will be appreciated that a range of modifications and alterations may be made to the arrangement described hereinbefore without departing from the scope of the invention.

We claim:

1. A steerable drilling system comprising:

a bias unit, the bias unit having at least one actuator operable by pressurized drilling fluid or mud delivered downhole to the at least one actuator, and a separator arranged to remove particulate matter from the supply of pressurized drilling fluid or mud to the at least one actuator, the separator comprising a hydrocyclone located upstream of the at least one actuator to remove the particulate matter before the drilling fluid or mud acts on the at least one actuator, wherein the hydrocyclone includes a housing defining a substantially conical recess having a large diameter end and a small diameter end, an inlet in fluid communication with the large diameter end for providing the drilling mud thereto, a first outlet in fluid communication with the small diameter end for outlet of relatively dirty mud, and a second outlet in fluid communication with the large diameter end for outlet of a supply of relatively clean mud for the plurality of actuators, wherein the separator is arranged such that particulate matter separated from the supply of drilling fluid or mud to the at least one actuator rejoins a flow of drilling fluid or mud towards a drill bit.

2. The system according to claim 1, wherein the separator is integrally formed with the bias unit.

3. The system according to claim 1, wherein the separator and bias unit are separate components, the separator being located upstream of the bias unit so that the drilling fluid from which matter has been separated by the separator is supplied directly to the bias unit.

4. The system according to claim 3, wherein the separator is located immediately upstream of the bias unit.

5. The system according to claim 1, further comprising a filter to remove relatively large dimension particles from the supply of drilling fluid or mud.

6. A steerable drilling system using pressurized drilling mud in a formation of a borehole comprising:

a) an elongated drill collar defining an interior;

b) a plurality of bias pads mounted on the drill collar, each bias pad being movable between a radially inner position and an extended position in which a wall of the formation is engaged such that a sideways acting load on the drill collar results;

c) a plurality of actuators, each bias pad having a respective actuator driven by the drilling mud; and d) a separator arranged to remove particulate matter from the drilling mud upstream from the plurality of actuators, the separator including a housing defining a substantially conical recess having a large diameter end and a small diameter end, an inlet in fluid communication with the large diameter end for providing the drilling mud thereto, a first outlet in fluid communication with the small diameter end for outlet of relatively dirty mud, and a second outlet in fluid communication with the large diameter end for outlet of a supply of relatively clean mud for the plurality of actuators, the supply of relatively clean mud being delivered to the plurality of actuators while the flow of relatively dirty mud from the first outlet is directed to rejoin the flow of drilling mud further downstream within the drill collar.

7. A steerable drilling system as recited in claim 6, wherein the inlet and the first outlet are radial paths and the second outlet is an axial path.

8. A steerable drilling system as recited in claim 6, wherein the inlet is generally tangential to the large diameter portion.

9. A steerable drilling system as recited in claim 6, wherein the substantially conical recess forms an apex and the first outlet is in fluid communication with the apex.

10. A steerable drilling system as recited in claim 6, wherein the first outlet is in fluid communication with a flow of drilling mud passing through a drill collar to a drill bit.

11. A steerable drilling system as recited in claim 6, wherein each actuator includes a cylinder with a piston slidably mounted therein and connected to the respective bias pad such that the pressurized drilling mud is selectively supplied to the cylinder to cause movement of the piston and, in turn, the respective bias pad.

12. A steerable drilling system as recited in claim 6, further comprising a valve arrangement operative in a flow of the drilling mud to control delivery of the drilling mud to the plurality of actuators.

13. A steerable drilling system as recited in claim 6, further comprising:

a drill bit coupled to the drill collar; and a motor for powering the drill bit.

* * * * *